United States Patent [19]

Lerich

[11] 4,435,863

[45] Mar. 13, 1984

[54] PATIENT TRANSPORTING DEVICE

[76] Inventor: Joel Lerich, 1418 W. Oak St., Ft. Collins, Colo. 80521

[21] Appl. No.: 295,226

[22] Filed: Aug. 21, 1981

[51] Int. Cl.[3] ..... A61G 7/10

[52] U.S. Cl. ..... 5/81 B

[58] Field of Search ..... 5/81 R, 81 B, 86, 61, 5/83

[56] References Cited

U.S. PATENT DOCUMENTS

| | | | |
|---|---|---|---|
| 2,542,963 | 2/1951 | Knox et al. | 5/86 |
| 3,165,314 | 1/1965 | Clearman et al. | 5/81 R |
| 4,157,593 | 6/1979 | Kristensson | 5/81 R |

FOREIGN PATENT DOCUMENTS

| | | | |
|---|---|---|---|
| 2249613 | 7/1974 | Fed. Rep. of Germany | 5/453 |

*Primary Examiner*—Alexander Grosz

*Attorney, Agent, or Firm*—Hugh H. Drake

[57] ABSTRACT

To move a disabled person as between a bed and a wheel chair, the device includes a base with a support projecting upwardly therefrom. A chest pad is shaped to fit against the upper torso of the user that is secured thereto. A linkage assembly couples the chest pad to the support and includes a pivot enabling swinging of the chest pad about a horizontal axis, with the person emplaced, from a first position in which the chest pad is swung outwardly away from the support and a second position in which the chest pad has been swung overcenter to a stable location above the linkage assembly. Adjustment of elevation and spacing of the principal components is included, together with means for enabling rotation. Further components may enable swinging the basic chest pad about a vertical axis. Also included are preferably swingable means for securing the knees of the user in place as he or she is loaded onto the device.

21 Claims, 12 Drawing Figures

PATIENT TRANSPORTING DEVICE

The present invention relates a patient transporting device. More particularly, it pertains to a device that enables transferring a disabled person between, for example, a wheel chair and a bed.

In many cases involving a paraplegic, quadraplegic or other person so disabled that at least his lower extremities are not functional, it becomes necessary to arrange his transfer between such different objects as a bed, a wheel chair and a bathroom. Often, the patient is bodily transported by one or more others who have sufficient strength to accomplish the task. When an adequate number of persons are not available to assist in the moving operations, any attempt by an individual person or the patient alone to accomplish the task risks injury to that person or the patient.

Prior apparatus is known for assisting in such transportation of a disabled person. U.S. Pats. D. 247,458, 3,790,974 and 3,869,171 are only mentioned as being representative. More complicated prior arrangements have bee devised for the purpose of picking up and moving such a patient. Many entail large expense.

Sling arrangements have been popular. With the patient suspended, overhead apparatus can move the sling from place to place. However, the slings tend to cause abrasions and sores, and it is cumbersome and time consuming to load and unload the patient.

What appears to be missing from the prior art is a device that will enable a user to be transported with minimal additional assistance and yet which is reasonable in terms of cost. The primary objective of the present invention is to achieve that end.

Another object of the present invention is to devise a new and improved device that achieves the basic purpose but yet may avoid the need for the inclusion of expensive components such as motors.

A particular object of the present invention is to provide a new and improved device of the kind contemplated that, even for a full quadraplegic, requires the assistance for its use of no more than one other person and also guards against any requirement for an undue amount of effort by such other person.

In accordance with the present invention, a person transporting device has a base with a support that projects upwardly therefrom. A chest pad is shaped to fit against the upper torso of the user, and that upper torso is secured to the chest pad. A linkage assembly couples the chest pad to the support and includes means for enabling swinging of the chest pad effectively about a horizontal axis (with the user secured in place) from a first position in which the check pad is swung outwardly away from the support and a second position in which the check pad has been swung to a stable location above the linkage assembly. Many further features of adjustability and flexibility are included.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
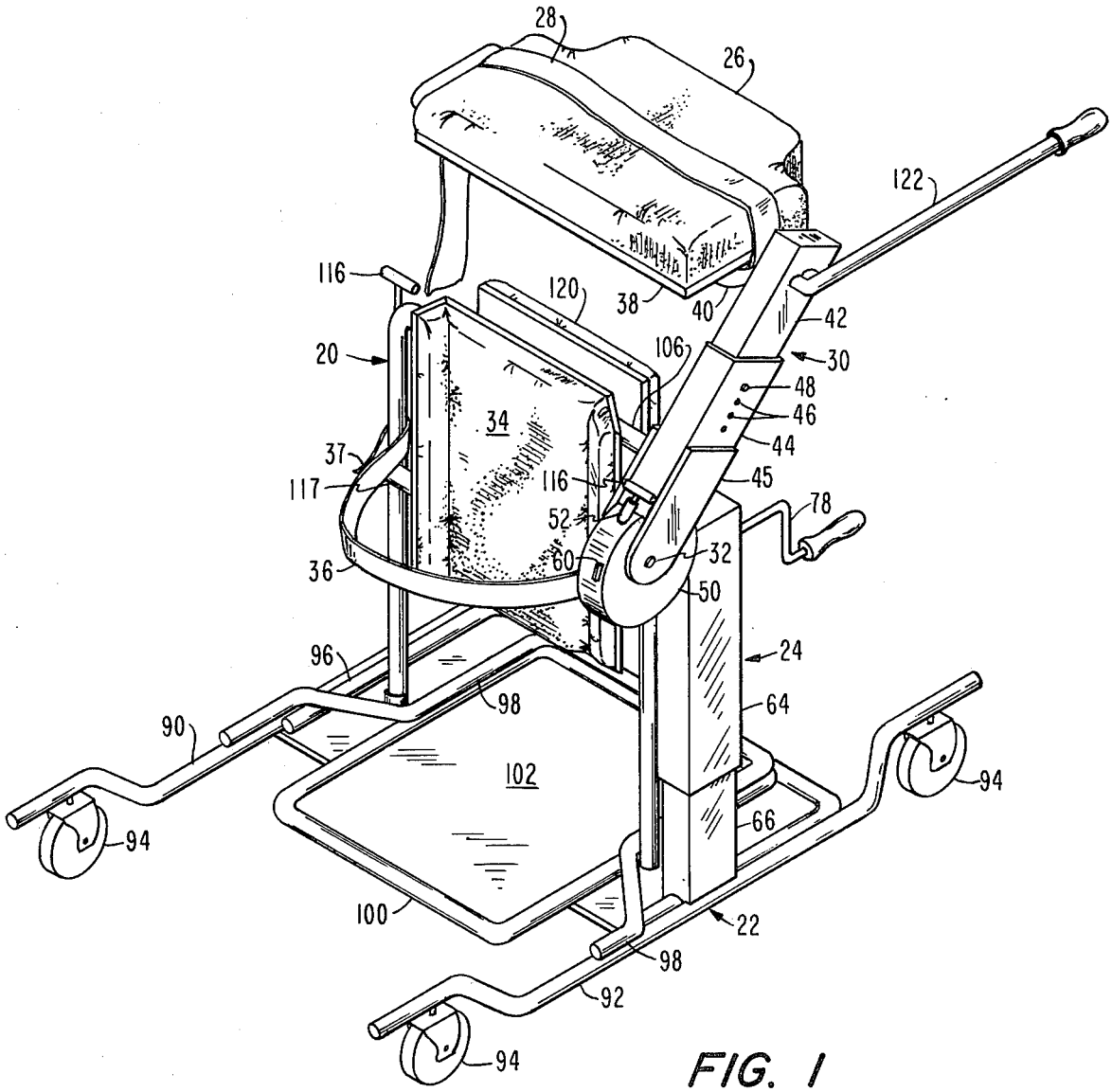
FIG. 1 is an isometric view of a patient transport device constructed in accordance with one embodiment of the present invention.

A patient transporting device 20 has, as generalized components, a base 22, a support 24 that projects upwardly from one side of base 22, a check pad 26 shaped to fit against the upper torso of the user and including an adjustably lockable strap assembly 28 for securing that upper torso against chest pad 26 and a linkage assembly 30 which couples chest pad 26 to support 24. Locking of the strap may be by any suitable means, such as a buckle. As herein embodied, Velcro fasteners are used. A pivot 32 enables swinging of chest pad 26 about the horizontal axis defined by that pivot. With the user strapped to the chest pad, linkage 30 may be swung from a first position, as shown in FIG. 1 in which chest pad 26 has been swung outwardly away from support 24, and a second position as shown in FIG. 2 in which chest pad 26 has been swung overcenter to a stable location above linkage assembly 30 and support 24 as well as base 22.

As will later be explained in more detail, this enables securing a patient to chest pad 26 when in the position of FIG. 2 and disposed over a bed, for example. Linkage 30 is then swung upwardly and, in a manner of a fundamental over-center toggle, continued in its movement to a stable position as shown in FIG. 1 in which the patient is securely and safely positioned atop the unit for transport elsewhere. The functional operation does not require strap assembly 28. However, it preferably is included for safety. Alternatively, bars arranged to fit under the armpits of the patient may be used for achieving stability.

Figure 2:
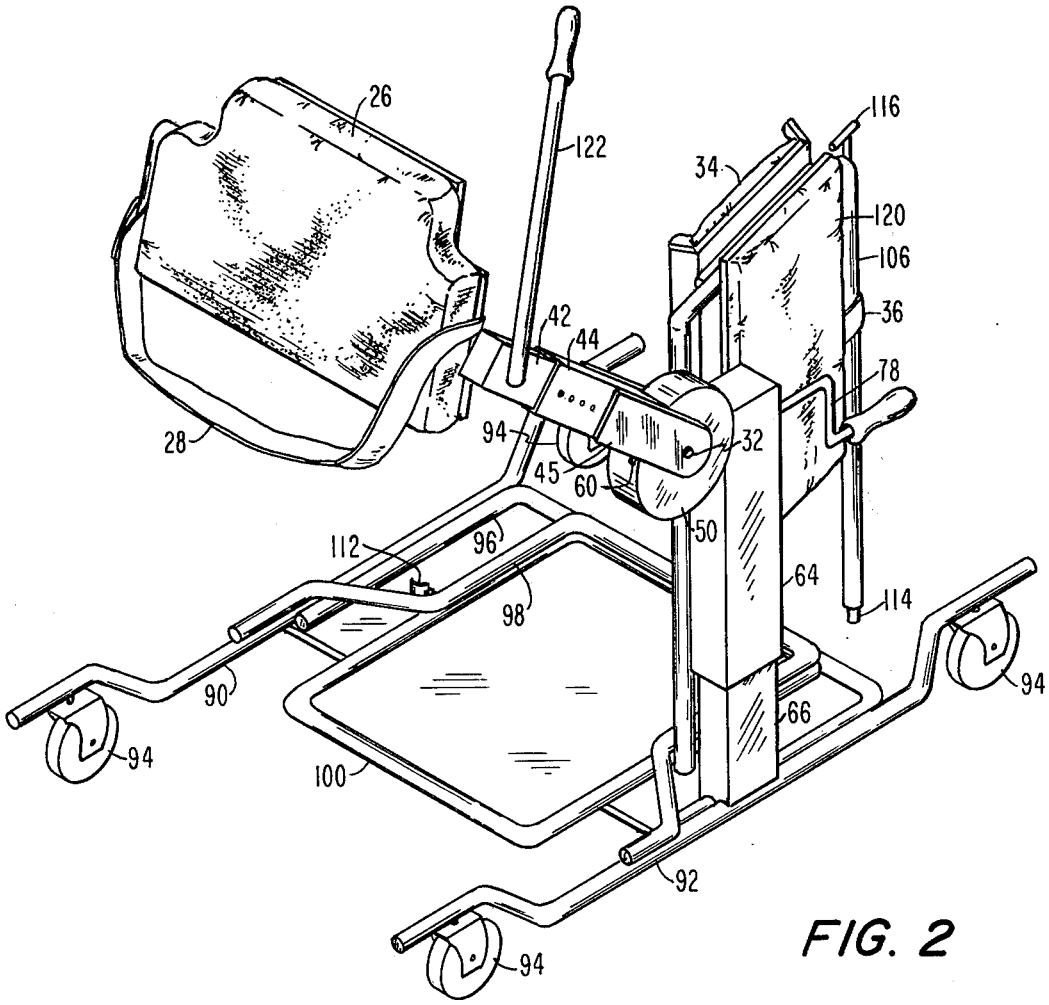
FIG. 2 is an isometric view similar to FIG. 1 but with certain of the components in a different position.
Figure 3:
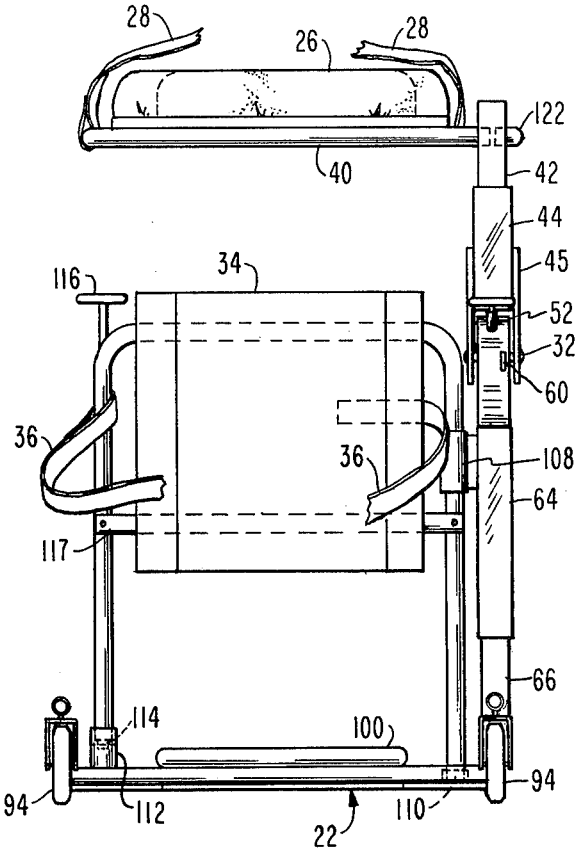
FIG. 3 is a rear elevational view thereof with the components in the position of FIG. 1.
Figure 4:
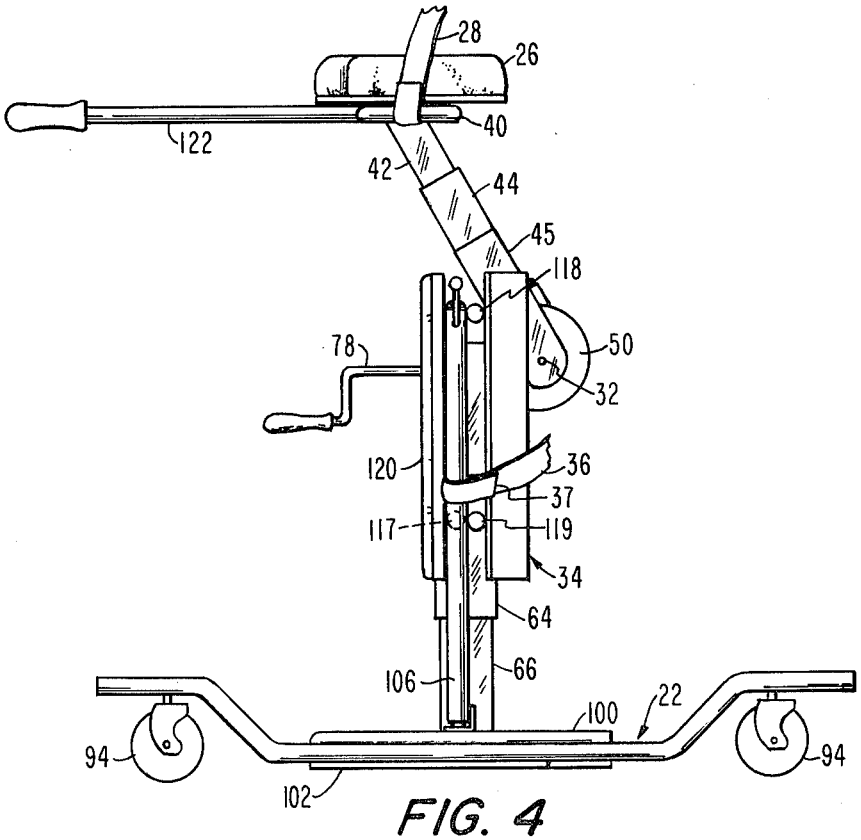
FIG. 4 is a side elevational view thereof with the components also in the position of FIG. 1.
Figure 5:
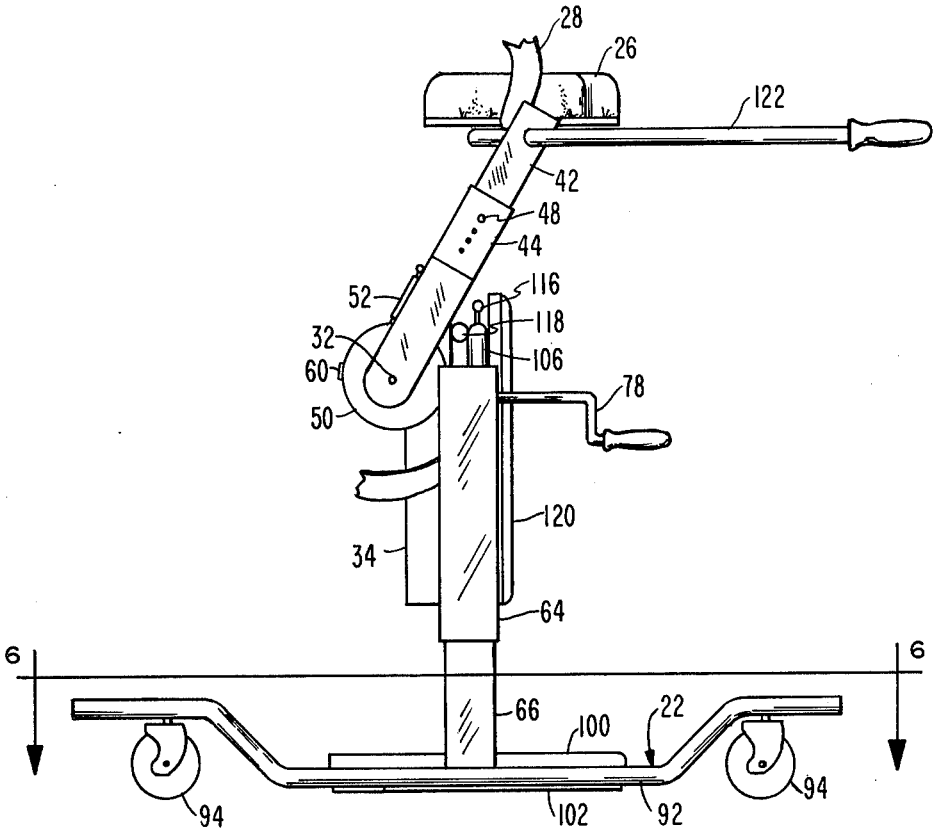
FIG. 5 is a side elevational view opposite that of FIG. 4.

As should become apparent, the weight of the patient is important in the preferred embodiment in insuring stability after movement into the position of FIG. 1. Without more, however, a portion of the full weight of the patient would need to be leveraged over center or otherwise raised to and held in a secure position.

Assisting further in the loading, therefore, is a knee pad 34 associated with a securing strap assembly 36. Again, any suitable fastener may be used, a Velcro fastener at 37 being shown. By placing the feet of the user on base 22 and then strapping those knees to pad 34, a significant portion or component of the patient's weight is carried by base 22 as his pelvic region and upper torso are fulcrumed about pivot 32 into the preferred over-center stable position of chest pad 26. In addition, knee pad 34 is constructed to exhibit sufficient strength to bear a significant forwardly-directed component of the patient's weight which effectively is transmitted down the thighs of the patient during the loading movement. Thus, a quadraplegic can readily be secured into place and loaded directly if the patient already is in a wheelchair. If in bed, for example, it is only necessary to move the person into a position with the feet dangling over the edge of the bed. Again, strap assembly 36 is not essential to the functional operation of loading the patient. For safety, its use is preferred and recommended.

In itself, pad 26 is a cushion mounted on a base 38. It is conformed and shaped to fit over the front of the user's chest and is composed of a vinyl covering which encloses a body of foam rubber. In this case, base 38, and thus pad 26, is affixed to a framework 40 secured, in turn, to the upper end of linkage assembly 30.

Linkage assembly 30 includes a sleeve 42 that telescopes within a sleeve 44. Sleeve 42 is affixed at one end to framework 40, while sleeve 44 is secured to a bracket 45 which, in turn, is pinioned on pivot 32. A series of mating apertures 46 spaced lengthwise along both sleeves enable the insertion of a pin 48 for the purpose of selectively adjusting the distance between pad 26 and pivot 32. This enables device 20 to be adapted to accommodate different users of various heights and weights so as to achieve stability in use.

Rigidly affixed with respect to support 24 is a drum 50. Firmly secured to sleeve 44 is a spring-loaded lock or catch 52. Lock 52 includes a plunger 54 engageable within an aperture 56, in the peripheral surface of drum 50, for the purpose of insuring that pad 26, with the patient loaded thereon, is safely maintained when everything is in the position of FIG. 1.

Also included on the peripheral surface of drum 50 is a stop 60. That engages the inner end 61 of sleeve 44 as chest pad 26 is brought into the position shown in FIG. 2.

Included as part of support 24 is an elevator composed of an outer sleeve 64 that telescopes vertically over an inner sleeve 66. Sleeve 64 is affixed at its upper end to the periphery of drum 50. Sleeve 66 is affixed at its lower end to base 22. A screw 68, secured by a bearing 70 within outer sleeve 64, is threaded into a nut 72 affixed within inner sleeve 66. A crank 78 is coupled by bevel gears at 80 to screw 68 for enabling telescoping movement between sleeve 64 and 66 in a conventional manner. By turning crank 78, therefore, the height of chest pad 26 above base 22 may be adjusted for the purpose of achieving proper orientation with regard to such as a bed or chair.

The particular elevator arrangement illustrated is believed to be the most appropriate. Nevertheless, other known elevator arrangements could be substituted, subject to a caveat that any elevator assembly included should not be so heavy as to make device 20 have any tendancy to tilt to the side toward the elevator, particularly with the patient loaded. In one experimental modification, which may be preferred for the purpose of reducing cost or tolerances required, bevel gears 80 were replaced by a universal joint between crank 78 and screw 68.

Figure 6:
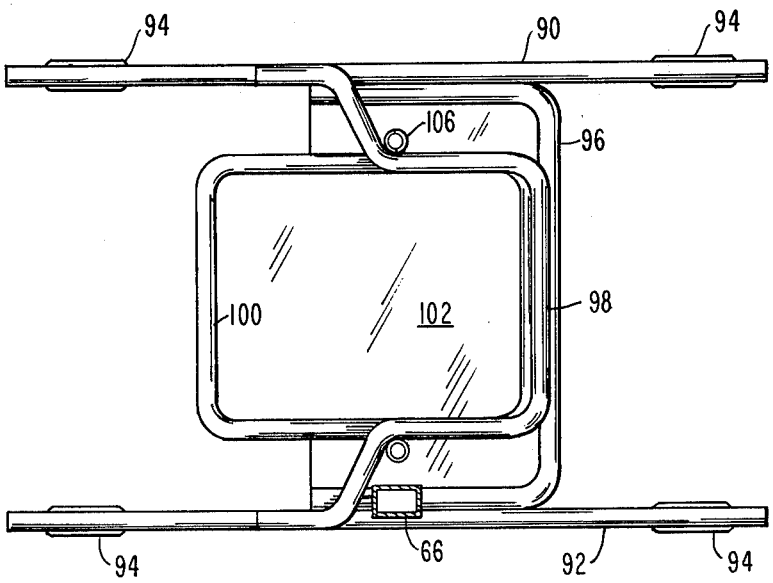
FIG. 6 is a cross sectional view taken along the line 6—6 in FIG. 5.
Figure 7:
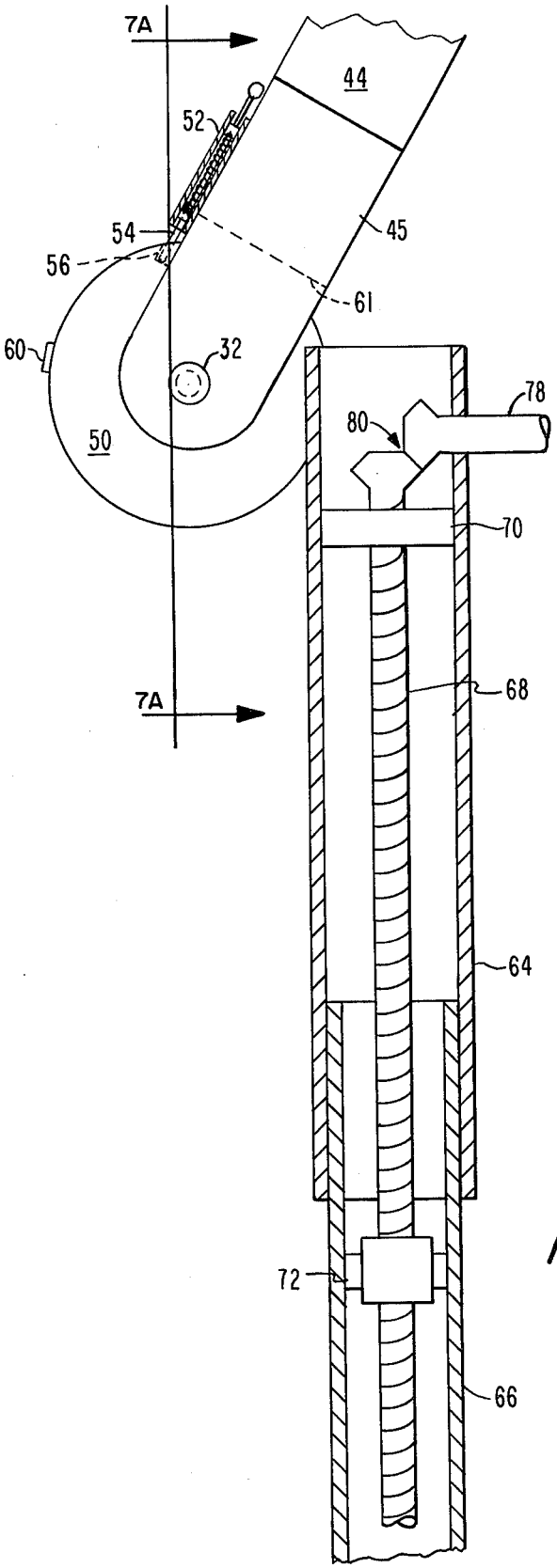
FIG. 7 is an enlarged, fragmentary view, partially broken away, of a portion of the apparatus shown in FIG. 3.
Figure 7A:
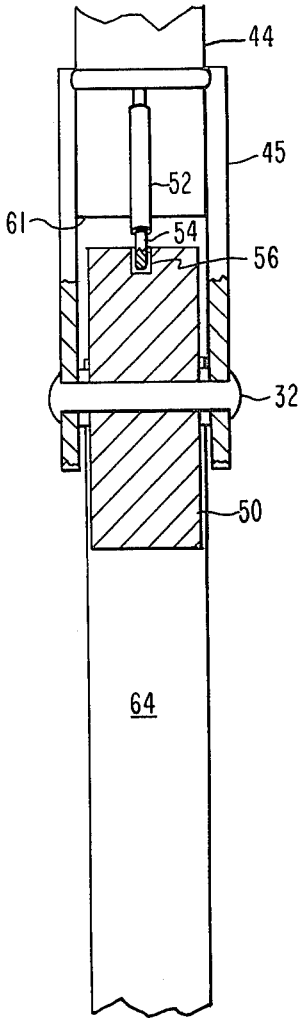
FIG. 7A is a view taken along the line 7A—7A in FIG. 7.

With reference to FIG. 6, it will be observed that base 22, in this case, is formed of a plurality of tubes suitably secured together and including various bends which lend additional strength. That tubing includes space-opposed runners 90 and 92 on each outer end portion of which are located dolly wheels 94.

Part of tubing 98 forms another rigidifying connection between runners 90 and 92. Secured in place beneath tubing 98 is a rectangularly-shaped tube 100. Further rigidifying the assembly is a plate 102 also affixed between runners 90 and 92 to which tubing 100 is directly affixed.

A first purpose of such interconnection between runners 90 and 92 is to complete the formation of base 22 as a structural assembly sufficiently strong to support what may be a heavy patient. Another purpose of the combination of tubing 98 and 100 is to enable placement and captivation of the feet within the defined rectangle while the user's knees are placed against knee pad 34 and preferably locked by strap assembly 36.

Figure 9:
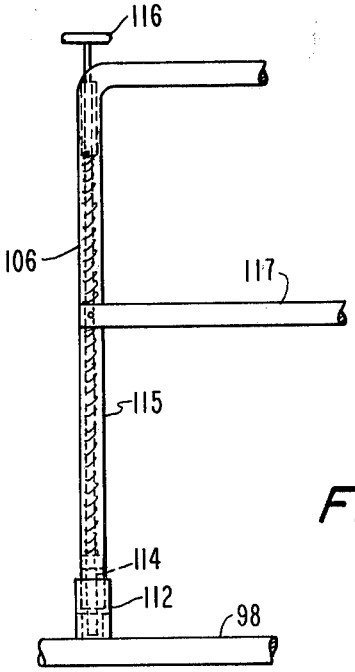
FIG. 9 is a fragmentary and enlarged schematic view of a portion of that shown in FIG. 3.

Upstanding from base 22 is a hoop 106. Rigidly extending from sleeve 64 is a bearing 108 for one leg of hoop 106. That leg is supported at its lower end in a corresponding bearing 110. Beneath the lower end of the other leg of hoop 106 is a latch 112. Disposed within that other leg is a plunger 114 which is loaded by a spring 115 to engage with latch 112 (FIG. 9). A handle 116, projecting outwardly from that other leg and secured to the upper end of plunger 114, is available to the user or operator for disengaging the connection between plunger 114 and latch 112.

Extending laterally between the legs of hoop 106 is a strut 117. Knee pad 34 is affixed between strut 117 and the bight of hoop 106 by spacers 118 and 119. Thus, operation of handle 116 to release the latch on hoop 106 permits the hoop and pad to be swung outwardly. Assuming a patient had just been deposited upon a bed, by a swinging of linkage 30 from the position of FIG. 1 to the position of FIG. 2, the knee pad 34 assembly may then be swung away so as to be removed from interfering with a subsequent swinging of the patient's legs up onto the bed. The converse applies when initially beginning the loading of the patient, at least under some conditions.

The principles involved in the illustrated embodiment could be carried forward to a more sophisticated extreme. A controlled power unit might be added to swing linkage 30 between the positions of FIGS. 1 and 2. Similarly, elevator 34 could be powered. Of course, wheels 94 might be driven by a power unit. To the extent that might be desired, all of those additions are contemplated. Nevertheless, they are quite apart from the basic purpose of the present disclosure which involves that of a unit intended for easier unloading and loading of a patient, while avoiding excessive cost.

A variety of other alternatives also are contemplated. As one example, some patients may be able to benefit from the stability provided by chest pad 26 even though knee pad 34 and its associated assembly has been eliminated. In another modification, a stub is secured to base 22 in a position to project upwardly within and is removably coupled to sleeve 66. For convenience of transport of the entire device, that permits separation of the base assembly from the superstructure.

In the preferred mode as shown, support 24 is displaced to one lateral margin of base 22. That keeps support 24 out of the way when the patient is being loaded or unloaded. In one alternative arrangement, support 24 could be more centrally located on base 22. While that would have the advantage of reducing the fulcrum strength required to maintain pad 26 in position, it interferes with the handling of the feet and legs of many patients.

Dolly wheels 94 enable rather complete mobility of device 20 with the patient loaded. However, they are not absolutely essential. The base need only be on gliders or skids. One earlier embodiment operated successfully with only that approach as to the base, so far as it enabled the loading of a patient from a bed to a wheel chair. With that approach, the unit was simply slid into place and the patient was secured to the chest pad. At the same time, however, the rotational freedom about a vertical axis was provided by a spindle action within support 24. That is, and once the patient had been loaded into the unit, the patient on chest pad 26 was rotated out from the bed, so that the patient could then be seated in a wheel chair or the like.

Accordingly, it is apparent that any rotational movement desired for positioning of the patient can be provided either within the upright support structure or, as specifically and preferably herein embodied, by the use of dolly wheels. Whether dolly wheels 94 are included, or the base includes only a simple skid or other arrangement, it is desired that base 22 have a low profile to the floor. That is for the purpose of permitting base 22 to be swung under a bed or the like in order to be able to obtain initial alignment of the patient who is to be loaded or subsequent similar alignment when that patient is to be unloaded.

In a different alternative, a simpler unit has support 24 affixed directly to the floor or other substrate. Chest pad 26 then swings about support 24, or the chest pad and the support move together about a pivot, to enable loading and unloading of the patient as, for example, between a bed and a wheel chair.

As indicated, a more-sophisticated, power-driven arrangement may be incorporated. At the same time, it is to be noted that the illustrated device may be greatly simplified, particularly as customized to a given user or to a given situation. Length adjustability within linkage assembly 30 would not be necessary if the unit is first customized or otherwise satisfactory to the user for the purpose intended. Elevator 34 would not be necessary if the usage is to be definitely related to transport to and from a particular height of patient locations. One feature, therefore, is that the cost of the device as supplied to a given purchaser may be capable of being reduced through elimination of otherwise advantageous features that that purchaser does not require.

Facing knee pad 34, in a back-to-back relationship, is another pad 120. It is mounted on the opposite side of hoop 106 from pad 34. Pad 120 allows an operator to rest his or her knees against pad 120 while manipulating linkage assembly 30 for the purpose of loading the patient.

Extending outwardly from the upper end of linkage 30 is a handle 122. Handle 122 enables an assisting operator to better facilitate the pulling of linkage 30 and chest pad 26, with the patient loaded, into the over-center stable position. In this case, handle 122 is adjustably coupled to the upper end of linkage 30 so as to enable the handle to be conveniently rested in an out-of-way position when not in use.

Figure 8A:
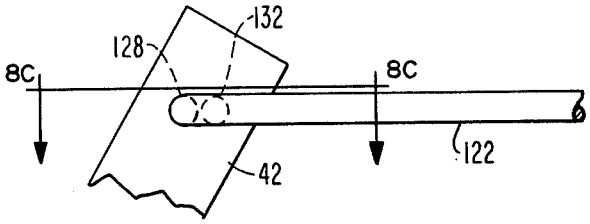
FIG. 8A is an enlarged, fragmentary view of a portion of the apparatus shown in FIG. 3.
Figure 8B:
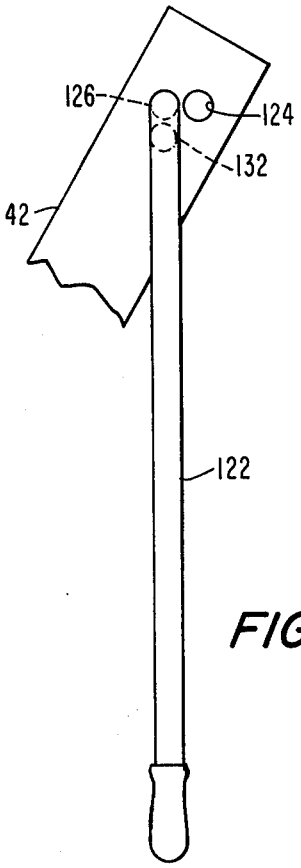
FIG. 8B is a view like FIG. 8A but with components differently positioned.
Figure 8C:
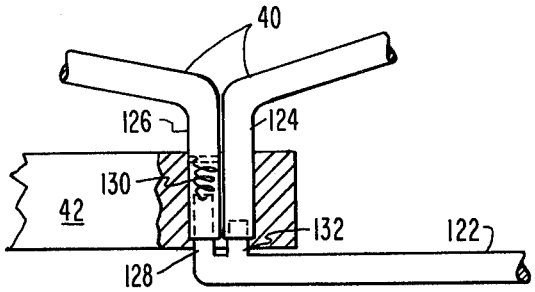
FIG. 8C is a cross-sectional view, partially broken away, taken along the line 8C—8C in FIG. 8A.

More specifically, framework 40 terminates in end portions 124 and 126 seated in sleeve 42 to define respective recesses. A lateral finger 128 on handle 122 is held within portion 126 by a spring 130. A parallel finger 132 is receivable within end portion 124. In use, handle 122 is locked in place as shown in FIGS. 8A and 8C. For storage, handle 122 is pulled away from sleeve 42 and swung to the position shown in FIG. 8B

For the usual reasons of obtaining structural strength, the embodied apparatus illustrates the use of round tubing. Of course, all such components may be replaced with other structural formations such as channel irons, angle irons and so forth. Because elevation of the assembly, to fit a given situation, need not always be done with the patient loaded, it also should be apparent that mere pins or other arrangements may be used to afford that adjustment.

The inclusion of pivot 32 is believed to be the most effective means of accomplishing the overall purpose. However, the movement of chest pad 26 between its limit positions of movement may be achieved by the use of other means. For example, the chest pad may slide or roll along a track or be supported by a parallelogram arrangement or other leverage approach.

For the reason of achieving inherent and, perhaps, safest stability of the patient when "mounted" on the device for movement, the overcenter toggle geometry is preferred. Nevertheless, it still would be advantageous merely to be able to swing the patient, secured to the chest pad, toward and away from a bed or chair. For that mode of operation, chest pad 26 must be most securely locked to the linkage assembly or another portion of the device when swung to the more upright position in which the patient is carried by the device.

As illustrated and described, there has been disclosed a principle of device construction that may be advantageous to anyone who needs a wheel chair. Yet, no sling under the patient is needed. It extends to the efficient and safe handling of a patient who may be a quadraplegic. For at least most patients, the knees must be stabilized for the device to work in satisfactorily handling the upper torso that includes the head, neck and shoulders.

The device is capable of economic adaptation to any particular user. At the same time, however, the basic principles may be expanded to accommodate either additional needs or additional desires. For example, a toilet seat may be swingably or otherwise mounted for movement to a position that subsequently assists the patient. The end result is that a patient, who can't entirely help himself, is greatly assisted in accomplishing movement. A related result is that, where the assistance of another person is required, such other person is enabled to better and more easily accomplish the task of concern.

While a particular embodiment of the invention has been shown and described, and other modifications and alternatives have been disclosed, it will be obvious to those skilled in the art that further changes and modifications may be made without departing from the invention in its broader aspects. Therefore, the aim in the appended claims is to cover all such changes and modifications as fall within the true spirit and scope of that which is patentable.

I claim:

1. A patient transporting device comprising:

a support projecting upwardly from a base;

a chest pad shaped and oriented to fit against the upper torso of the user when the lower torso of the user is positioned beneath said chest pad;

and a linkage assembly coupling said chest pad to said support and including means for enabling swinging of said chest pad effectively about a horizontal axis, with said upper torso secured to said chest pad, from a first position in which said chest pad is swung outwardly away from said support to permit engagement of said chest pad with said upper torso when said lower torso is positioned beneath said chest pad and a second position in which said chest pad has been swung by said linkage assembly to a stable location above said linkage assembly to have moved upwardly said upper torso with said lower torso remaining beneath said chest pad.

2. A device as defined in claim 1 in which said enabling means includes a pivot about which said chest pad is swung.

3. A device as defined in claim 1 in which said linkage assembly is dimensioned and oriented to enforce a swinging of said chest pad geometrically over-center to said stable location.

4. A device as defined in claim 1 which further includes means for securing said upper torso to said chest pad.

5. A device as defined in claim 1 which further includes means for adjusting elevation of said chest pad relative to said support.

6. A device as defined in claim 5 in which said adjusting means raises and lowers said linkage assembly.

7. A device as defined in claim 1 which further includes means for enabling rotation of said chest pad, with said upper torso secured thereto, about a vertical axis relative to said support.

8. A device as defined in claim 7 in which said enabling means includes a base assembly and a set of wheels upon which said base assembly is mounted.

9. A device as defined in claim 1 which includes means for locking said linkage assembly in said second position.

10. A device as defined in claim 1 which includes a stop for maintaining said linkage in said first position.

11. A device as defined in claim 1 which further includes a knee pad coupled to said support, said knee pad having a conformation to accept placement of the knees of the user thereagainst.

12. A device as defined in claim 11 in which said knee pad is swingable about a vertical axis relative to said support.

13. A device as defined in claim 12 which includes means for locking said knee pad in a position aligned relative to said chest pad to enable loading of the user.

14. A device as defined in claim 11 which also includes means for securing the knees of the user against said knee pad.

15. A device as defined in claim 11 in which said knee pad exhibits sufficient strength to bear a significant component of the patient's weight during said swinging.

16. A device as defined in claim 11 which includes a second knee pad disposed back-to-back with respect to said first-mentioned knee pad.

17. A device as defined in claim 1 in which said support projects upwardly only from at least near one side of said base.

18. A device as defined in claim 1 which includes means in said linkage assembly for selectively adjusting the distance between said chest pad and said horizontal axis.

19. A device as defined in claim 1 which includes means on said base for captivating the feet of the user when placed thereon in use.

20. A device as defined in claim 1 in which said base exhibits sufficient strength to support a significant component of the patient's weight during said swinging.

21. A patient transporting device comprising:

a base;

a support projecting upwardly from said base;

a chest pad shaped to fit against the upper torso of the user;

means for securing said upper torso to said chest pad;

a linkage assembly coupling said chest pad to said support and including means for enabling swinging of said chest pad effectively about a horizontal axis, with said upper torso secured to said chest pad, from a first portion in which said chest pad is swung outwardly away from said support and a second position in which said chest pad has been swung over-center to a stable location above said linkage assembly;

a knee pad coupled to said support and having a conformation to accept placement of the knees of the user thereagainst;

and means for securing the knees of the user against said knee pad.

* * * * *